US005332206A

United States Patent [19]

Hirose et al.

[11] Patent Number: 5,332,206

[45] Date of Patent: Jul. 26, 1994

[54] PAPER FEED SUCTION APPARATUS

[75] Inventors: Norio Hirose; Masaaki Ishida, both of Ibaragi, Japan

[73] Assignee: Komori Corporation, Tokyo, Japan

[21] Appl. No.: 112,434

[22] Filed: Aug. 26, 1993

[30] Foreign Application Priority Data

Sep. 3, 1992 [JP] Japan ..... 4-067551

[51] Int. Cl.[5] ..... B65H 3/08

[52] U.S. Cl. ..... 271/90; 271/93; 271/103

[58] Field of Search ..... 271/11, 14, 90–93, 271/103, 107

[56] References Cited

U.S. PATENT DOCUMENTS 3,931,964 1/1976 Schwebel ..... 271/93
4,438,916 3/1984 Kawaguchi .
4,458,891 7/1984 Kawaguchi ..... 271/93

FOREIGN PATENT DOCUMENTS 145741 9/1982 Japan .
24511 5/1991 Japan .

*Primary Examiner*—D. Glenn Dayoan
*Assistant Examiner*—Boris Milef
*Attorney, Agent, or Firm*—Blakely, Sokoloff, Taylor & Zafman

[57] ABSTRACT

A paper feed suction apparatus includes a cylindrical guide nozzle, a cylindrical intermediate nozzle with a collar, a tension coil spring, a bottomed-cylindrical suction port member, a compression coil spring, and a stopper. The cylindrical intermediate nozzle is supported on a frame side and has an inner hole connected to an air source. The cylindrical intermediate nozzle with the collar is fitted on an outer circumferential surface of the guide nozzle to be vertically movable. The tension coil spring has an upper end portion fixed on the guide nozzle side and a lower end portion fixed on the intermediate nozzle side, and biases the intermediate nozzle upward. The bottomed-cylindrical suction port member is fitted on an outer circumferential surface of the intermediate nozzle to be vertically movable and has a suction hole in its lower end face. The compression coil spring is interposed between the suction port member and the guide nozzle, and biases the suction port member downward. The stopper is supported on the frame side to be vertically movable and located above the collar of the intermediate nozzle, and regulates an upper end limit of the intermediate nozzle.

1 Claim, 2 Drawing Sheets

PAPER FEED SUCTION APPARATUS

BACKGROUND OF THE INVENTION

The present invention relates to a paper feed suction apparatus in a sheet-fed press or the like, which draws each paper sheet stacked on a paper stack table or the like from the highest one and supplies it to the latter feed stage.

In a sheet-fed press or folding machine, a paper feed suction apparatus called a sucker apparatus is provided to a paper feed apparatus for supplying the paper sheets to a printing press. The sucker apparatus draws the paper sheets stacked on the paper stack table or the like one by one from the highest one and supplies them to the latter stage such as a paper feed roller of the paper feed apparatus.

A conventional sucker apparatus used as the paper feed suction apparatus of this type comprises a first suction port mechanism of a triple structure and a second suction port mechanism, both of which are supported on a sucker frame side, as disclosed in Japanese Patent Laid-Open No. Sho 57-145741 (corresponding to Japanese Patent Publication No. 1-34903 and U.S. Pat. No. 4,438,916).

More specifically, the first suction port mechanism has the triple structure constituted by a cylindrical guide nozzle, a cylindrical intermediate nozzle, and a cylindrical suction port member. The guide nozzle is supported by the sucker frame and connected to a suction air source. The intermediate nozzle is fitted on the lower small-diameter portion of the guide nozzle to be vertically movable and biased downward by an outer spring. The suction port member is fitted on the outer circumference of the intermediate nozzle to be vertically movable and biased downward by an inner spring. A suction hole is formed in the lower end portion of the suction port member, so that the inner hole of the suction port member communicates with the outside.

With this arrangement, when a printing operation is to be started, the intermediate nozzle and the suction port member are located below by a cam mechanism, and the lower end face of the suction port member is close to the upper end face of the stacked paper sheets. In this state, when a feeding operation is started, and an air suction is performed, the uppermost paper sheet is drawn to its lower end face by the suction hole of the suction port member. Since the suction hole is closed by the paper sheet, a continuous air suction causes a change in pressure inside the suction port member, the intermediate nozzle, and the guide nozzle to a negative pressure with respect to an atmospheric pressure. The inner spring is compressed by the atmospheric pressure to move the suction port member upward with the paper sheet being chucked on the lower end face.

When the collar of the suction port member abuts against the collar of the intermediate nozzle, the upward movement of the suction port member is temporarily stopped. At the same time, the intermediate nozzle is moved upward by the cam mechanism, so that the suction port member and the intermediate nozzle are moved upward together while compressing the outer and inner springs. At the upper limit, the suction air acts on the second suction port mechanism, and the supply of the suction air to the first suction port mechanism is stopped. The paper sheet is transferred from the first suction port mechanism to the second suction port mechanism. The second suction port mechanism moves forward to cause the paper feed roller of the latter feed stage to grip the paper sheet.

In the above-described conventional paper feed suction apparatus, however, the first suction port mechanism has the triple structure, which causes an increase in number of components and weight. In addition, since the cam mechanism forces the intermediate nozzle to move in the vertical direction, a distortion is generated between the intermediate nozzle and the guide nozzle. Hence, a paper feed error tends to occur.

In order to solve the above problem, the present applicant has proposed a paper feed suction apparatus disclosed in Japanese Utility Model Publication No. 3-24511. This apparatus will be described below with reference to FIGS. 3 and 4. FIG. 3 shows a paper feed suction apparatus, and FIG. 4 shows a first suction port mechanism.

Referring to FIGS. 3 and 4, a sucker frame 2 is disposed above paper sheets 1 stacked on a paper stack table through a paper stack plate. The sucker frame 2 projects backward from the upper end portion of a paper feed frame. A cam 3 is axially mounted on a shaft axially supported by the sucker frame 2. A pair of left and right first suction port mechanisms 4 are provided to the lower end portion of the sucker frame 2. The first suction port mechanisms 4 are supported by U-shaped holders 5 projecting from the sucker frame 2. A pair of left and right second suction port mechanisms (neither are shown) connected to an air source are disposed in front of the first suction port mechanisms 4 in correspondence with each other.

Each first suction port mechanism 4 comprises a cylindrical guide nozzle 7 swingably supported on the corresponding holder 5 by a pin 6 and having the inner hole connected to the air source. A controller (not shown) coupled to the upper U-shaped portion of each guide nozzle 7 controls the gradient of the whole first suction port mechanism 4.

Reference numeral 8 denotes a suction port member having a bottomed-cylindrical shape and fitted on the outer circumferential surface of the guide nozzle 7 to be vertically movable. A plurality of suction holes **8*a* are formed in the lower end face of the suction port member 8. The suction port member 8 is biased downward by a suction port spring 9 interposed between the lower-end step portion of the inner hole and the step portion of the guide nozzle 7. When one end of a collar 8*b* of the suction port member 8 is brought into slidable contact with a guide 10 stationarily suspending from the holder 5, the pivotal movement of the suction port member 8** is regulated.

A roller lever 12 and an arm 13 are integratedly formed in an L-shaped form and axially mounted on the central portion of an arm shaft 11 pivotally axially supported between the left and right sucker frame 2. A cam follower 14 pivotally mounted on the roller lever 12 opposes the cam 3 having a cam surface comprising large- and small-diameter portions. Reference numeral 15 denotes a tension spring for applying a biasing force to the arm 13 in a direction to press the cam follower 14 against the cam surface of the cam 3.

The central portion of a guide bar 16 which horizontally extends in parallel to the arm shaft 11 is fixed and supported on the free end portion of the arm 13 by split clamping. A holder 17 is fixed at each end portion of the guide bar 16 by split clamping. An upper stopper shaft 18 is fixed on the upper end portion of the holder 17 by split clamping. An upper stopper 19 is located above the collar 8*b* and pivotally fitted on the distal end portion of the upper stopper shaft 18.

A lower stopper shaft 20 is fixed on the lower end portion of the holder 17 in parallel to the upper stopper shaft 18. A lower stopper 21 is located under the collar 8*b* and pivotally fitted on the distal end portion of the lower stopper shaft 20. With this arrangement, when the suction port member 8 abuts against the upper or lower stopper 19 or 21, the upward or downward movement of the suction port member 8 is regulated.

In the above arrangement, a printing operation is started in a state in which the suction port members 8 are moved downward, supported by the lower stoppers 21, and stopped while keeping the lower end faces close to the paper sheet 1. When suction air acts on the first suction port mechanisms 4, the uppermost paper 25 sheet 1 is chucked on the lower end faces of the suction port members 8. The suction holes 8*a* of the suction port members 8 are closed by the paper sheet 1 to cause a change in pressure inside the inner holes of the suction port members 8 and the guide nozzles 7 to a negative pressure. The pressure difference between the internal and the external pressures moves the suction port members 8 upward together with the paper sheet 1 against the biasing forces of the suction port springs 9.

When the collars 8*b* abut against the upper stoppers 19, the suction port members 8 are temporarily stopped. At this time, the contact portion between the rotating cam 3 and the cam follower 14 is shifted from the large-diameter portion to the small-diameter portion. The holders 17 are moved upward through the swingable movement of the arm 13, and the upper stoppers 19 are moved upward to escape from the collars 8*b*. At the same time, the suction port members 8 follow the upper stoppers 19 to be moved upward. At the upper limit, the supply of the suction air to the first suction port mechanisms 4 is stopped, and the suction air acts on the second suction port mechanisms. The paper sheet 1 is transferred from the first suction port mechanisms 4 to the second suction port mechanisms and conveyed for feeding.

At the upper limit where the suction port members 8 moved upward by the suction air are stopped, the cam follower 14 completely reaches the small-diameter portion of the cam 3. At this time, however, the lower stoppers 21 are not in contact with the collars 8*b*. Hence, after the paper sheet 1 is transferred, the pressure inside the suction port members 8 becomes almost equal to the atmospheric pressure, so that the suction port members 8 are moved downward by the biasing forces of the suction port springs 9 and temporarily stopped when the collars 8*b* abut against the lower stoppers 21. At this time, the contact portion between the cam 3 and the cam follower 14 is shifted from the small-diameter portion to the large-diameter portion. The lower stoppers 21 are moved downward through the swingable movement of the arm 13, and the suction port members 8 follow the lower stoppers 21 to be moved downward.

The lower stoppers 21 support the collars 8*b* of the suction port members 8 at the lower boundary and stop the suction port members 8 at a predetermined distance from the paper sheet 1. The suction port members 8 are quickly moved upward with the paper sheet 1 being chucked thereon, abut against the upper stoppers 19, and thus temporarily stopped. In this case, the suction port members 8 are moved upward by a smaller ascending amount than that of continuous ascending without any stop. In addition, an impact acting when the suction port members 8 abut against the upper stoppers 19 makes it possible to reliably separate the chucked paper sheet 1 from the second paper sheet.

In the conventional paper feed suction apparatus, however, the weights of the suction port members 8 are increased. Follow-up performance in a high-speed operation is degraded. As a result, the contact timing between the collars 8*b* of the suction port members 8 and the upper stoppers 19 is lagged. Therefore, it may be impossible to temporarily stop the suction port members 8.

More specifically, after the collars 8*b* abut against the upper stoppers 19 to stop the suction port members 8, the arm 13 and the suction port members 8 are moved together by the operation of the cam 3. If this timing is lagged, the arm 13 is moved before the collars 8*b* of the suction port members 8 abut against the upper stoppers 19. In this case, the timing of a temporary stop required to eliminate the operation lag between the left and right suction port members 8 operated by the suction air may be lagged or lost.

SUMMARY OF THE INVENTION

It is an object of the present invention to provide a paper feed suction apparatus, which can eliminate a distortion and achieve stable high-speed follow-up performance of suction port members.

In order to achieve the above object, there is provided a paper feed suction apparatus comprising a cylindrical guide nozzle supported on a frame side and having an inner hole connected to an air source, a cylindrical intermediate nozzle with a collar, fitted on an outer circumferential surface of the guide nozzle to be vertically movable, a tension coil spring, having an upper end portion fixed on the guide nozzle side and a lower end portion fixed on the intermediate nozzle side, for biasing the intermediate nozzle upward, a bottomed-cylindrical suction port member fitted on an outer circumferential surface of the intermediate nozzle to be vertically movable and having a suction hole in a lower end face thereof, a compression coil spring, interposed between the suction port member and the guide nozzle, for biasing the suction port member downward, and a stopper, supported on the frame side to be vertically movable and located above the collar of the intermediate nozzle, for regulating an upper end limit of the intermediate nozzle.

When the printing operation is to be started, the stoppers are moved downward by the cam mechanism. Accordingly, the intermediate nozzles and the suction port members are moved downward, and the lower end portions of the suction port members are close to the upper end face of the stacked paper sheets. In this state, the feeding operation is started, and the air suction is performed. The uppermost paper sheet is drawn by the suction holes of the suction port members and chucked on the lower end faces of the suction port members. Since the suction holes are closed by the paper sheet, the continuous air suction causes a change in pressure inside the suction port members, the intermediate nozzles, and the guide nozzles to a negative pressure with respect to the atmospheric pressure. The compression coil springs are compressed by the atmospheric pressure to move the suction port members upward with the paper sheet chucked on its lower end faces.

When the collars of the intermediate nozzles abut against the stoppers, the suction port members are temporarily stopped. At this time, the stoppers are moved upward by the cam mechanism to escape from the collars of the intermediate nozzles. The intermediate nozzles and the guide nozzles follow the stoppers to be moved upward together by the tensile forces of the tension springs. In this case, the intermediate nozzles and the guide nozzles are moved upward by the suction force of the air and the tensile forces of the tension springs, so that good follow-up performance can be obtained. In addition, the driving force for moving the intermediate nozzles and the suction port members upward acts on the axes of the intermediate nozzles. Therefore, the distortion of the intermediate nozzles can be avoided.

The intermediate nozzles and the suction port members are then moved upward to the upper limit. The suction air acts on the second suction port mechanisms, and the supply of the suction air to the first suction port mechanisms is stopped. The paper sheet is transferred from the first suction port mechanisms to the second suction port mechanisms. The second suction port mechanisms move forward to cause the sheet feed roller of the latter feed stage to grip the paper sheet.

DESCRIPTION OF THE PREFERRED EMBODIMENT

Figure 1:
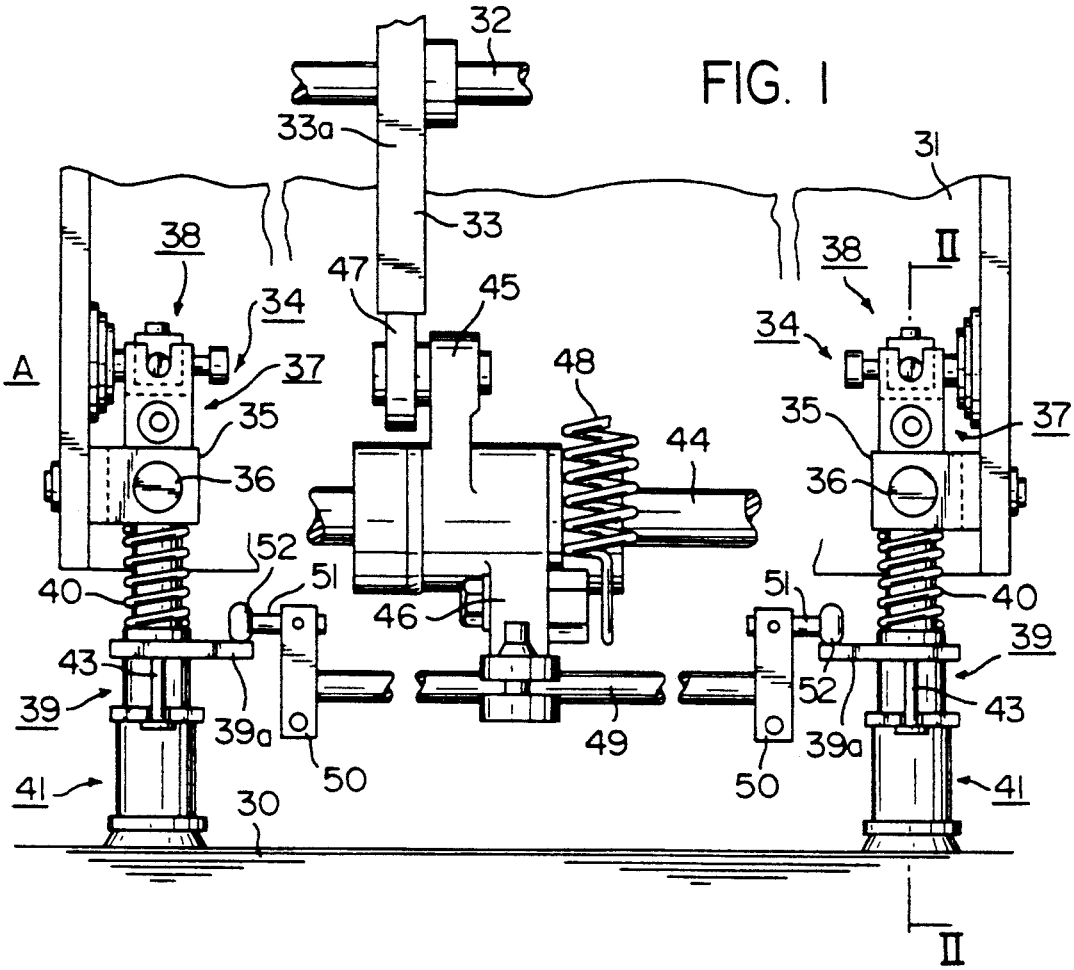
FIG. 1 is a front view showing a paper feed suction apparatus.
Figure 2:
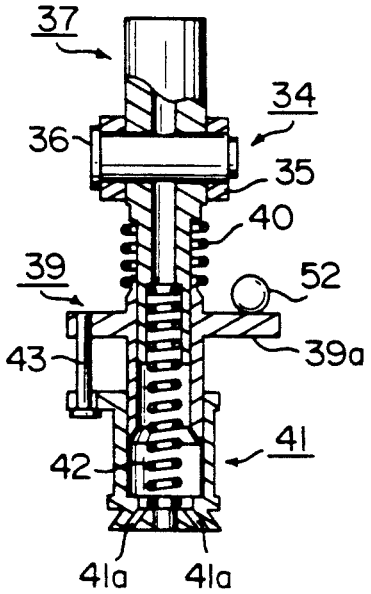
FIG. 2 is a longitudinal sectional view showing a first suction port mechanism taken along the line II—II.
Figure 3:
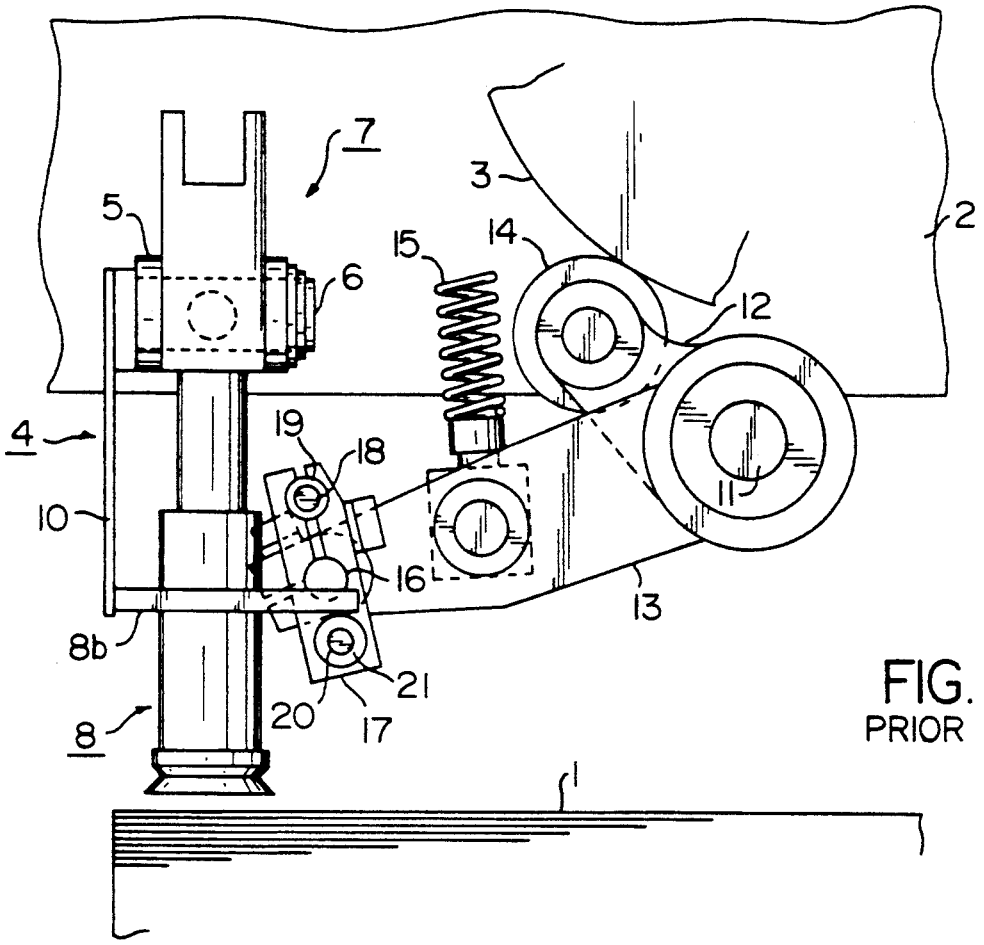
FIG. 3 PRIOR ART
FIG. 3 is a side view showing a conventional paper feed suction apparatus.
Figure 4:
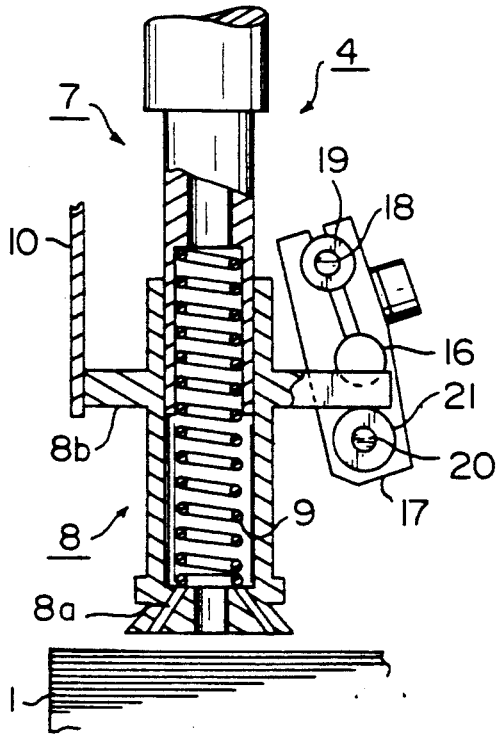
FIG. 4 PRIOR ART
FIG. 4 is a longitudinal sectional view showing a conventional first suction port mechanism.

FIGS. 1 and 2 show a paper feed suction apparatus according to an embodiment of the present invention. FIG. 1 shows the paper feed suction apparatus, and FIG. 2 shows a first suction port mechanism. Referring to FIGS. 1 and 2, a sucker frame 31 is disposed above paper sheets 30 stacked on a paper stack table through a paper stack plate. The sucker frame 31 projects backward from the upper end portion of a paper feed frame A. A cam 33 having a cam surface 33*a* comprising large- and small-diameter portions is axially mounted on a shaft 32 axially supported by the sucker frame 31.

A pair of left and right first suction port mechanisms 34 are provided to the lower end portion of the sucker frame 31. The first suction port mechanisms 34 are supported by U-shaped (when viewed from the top) holders 35 mounted on the inner surface of the sucker frame 31. A pair of left and right second suction port mechanisms (neither are shown) connected to an air source are disposed in front of the first suction port mechanisms 43 in correspondence with each other.

Each first suction port mechanism 34 comprises a cylindrical guide nozzle 37 swingably supported on the corresponding holder 35 by a pin 36 and having the inner hole connected to the air source. A controller 38 coupled to the upper U-shaped portion of the guide nozzle 37 controls the gradient of the whole first suction port mechanism 34.

Reference numeral 39 denotes a cylindrical intermediate nozzle fitted on the outer circumferential surface of the guide nozzle 37 to be vertically movable. A collar 39*a* is horizontally disposed at the upper end porion of the intermediate nozzle 39. A tension coil spring 40 for biasing the intermediate nozzle 39 upward is interposed between the step portion of the intermediate nozzle 39, formed above the collar 39*a*, and the step portion of the guide nozzle 37. The upper and lower ends of the tension coil spring 40 are respectively fixed on the step portion of the guide nozzle 37 and the step portion of the intermediate nozzle 39 and interposed therebetween.

A suction port member 41 having a bottomed-cylindrical shape is fitted on the circumferential surface of the intermediate nozzle 39 to be vertically movable. A plurality of suction holes 41*a* are formed in the lower end face of the suction port member 41. The suction port member 41 is biased downward by a compression coil spring 42 interposed between the lower end step portion of the inner hole of the suction port member 41 and the step portion of the inner hole of the guide nozzle 37. The pivotal movement of the suction port member 41 is regulated by a guide pin 43 slidably supported by the collar portion of the suction port member 41 and the collar 39*a* of the intermediate nozzle 39.

A roller lever 45 and an arm 46 are integratedly formed in an L-shaped form and axially mounted on the central portion of an arm shaft 44 pivotally axially supported between the left and right sucker frame 31. A cam follower 47 pivotally mounted on the roller lever 45 opposes the cam surface of the cam 33, which comprises the large- and small-diameter portions. Reference numeral 48 denotes a tension spring for applying a biasing force to the arm 46 in a direction to press the cam follower 47 against the cam surface of the cam 33.

A guide bar 49 having its central portion fixed on the free end portion of the arm 46 by split clamping extends to near the left and right first suction port mechanisms 34 in parallel to the arm shaft 44. A holder 50 is fixed on each end portion of the guide bar 49 by split clamping. A stopper shaft 51 is fixed on the upper end portion of the holder 50 by split clamping. A stopper 52 is located above the collar 39*a* and pivotally fitted on the distal end portion of the stopper shaft 51. With this arrangement, when the suction port member 41 abuts against the stopper 52, the upward movement of the suction port member 41 is regulated.

An operation of the paper feed suction apparatus having the above arrangement will be described. When the printing operation is to be started, the cam follower 47 opposes the large-diameter portion of the cam 33, so that the free end portion of the arm 46 is located below. Accordingly, the stoppers 52 are located at the lower position to press the intermediate nozzles 39 and the suction port members 41 to be located at the lower position. The lower end portions of the suction port members 41 are close to the upper end face of the stacked paper sheets 30.

In this state, the feeding operation is started, and the air suction is performed. The uppermost paper sheet 30 is drawn by the suction holes 41*a* of the suction port members 41 and chucked on the lower end faces of the suction port members 41. Since the suction holes 41*a* are closed by the paper sheet 30, the continuous air suction causes a change in pressure inside the suction port members 41, the intermediate nozzles 39, and the guide nozzles 37 to a negative pressure with respect to the atmospheric pressure. The compression coil springs 42 are compressed by the atmospheric pressure to move the suction port members 41 upward with the paper sheet 30 being chucked on the lower end faces.

When the collars 39*a* of the intermediate nozzles 39 abut against the stoppers 52, the suction port members 41 are temporarily stopped. At this time, the cam follower 47 is brought into contact with the small-diameter portion of the cam 33 to move the free end portion of the arm 46 upward, and the stoppers 52 are moved upward to escape from the collars 39*a* of the intermediate nozzles 39. The intermediate nozzles 39 and the guide nozzles 37 follow the stoppers 52 to be moved upward together by the tensile forces of the tension coil springs 40. In this case, the intermediate nozzles 39 and the guide nozzles 37 are moved upward by the suction force of the air and the tensile forces of the tension coil springs 40, so that good follow-up performance can be obtained. In addition, the driving force for moving the intermediate nozzles 39 and the suction port members 41 upward acts on the axes of the intermediate nozzles 39. Therefore, the distortion of the intermediate nozzles 39 can be avoided, and better follow-up performance can be obtained.

The intermediate nozzles 39 and the suction port members 41 are then moved upward to the upper limit. The suction air acts on the second suction port mechanisms, and the supply of the suction air to the first suction port mechanisms 34 is stopped. The paper sheet 30 is transferred from the first suction port mechanisms 34 to the second suction port mechanisms. The second suction port mechanisms move forward to cause the sheet feed roller of the latter feed stage to grip the paper sheet. After the paper sheet 30 is conveyed by the sheet feed roller, the suction port members 41 of the first suction port mechanisms 34 are moved downward by the biasing forces of the compression coil springs 42. The cam follower 47 is then brought into contact with the large-diameter portion of the cam 33 to move the free end portion of the arm 46 downward. The stoppers 52 press the collars 39*a* of the intermediate nozzles 39 downward against the tensile forces of the tension coil springs 40. The suction port members 41 are moved downward so as to almost bring its lower end faces into contact with the paper sheet 30, and feeding of one paper sheet is completed.

Although this embodiment indicates an example in which the present invention is practiced in a paper feed apparatus for a sheet-fed press, the present invention can also be practiced in a paper feed apparatus for a folding machine or the like to obtain the same effect.

As has been apparent from the above description, according to the present invention, in a paper feed suction apparatus, a cylindrical guide nozzle connected to an air source is supported on the frame side. A cylindrical intermediate nozzle with a collar is fitted on the outer circumferential surface of the guide nozzle to be vertically movable. The intermediate nozzle is biased upward by a tension coil spring having its upper and lower end portions respectively fixed on the guide nozzle side and on the intermediate nozzle side. A bottomed-cylindrical suction port member having suction holes in its lower end face is fitted on the outer circumferential surface of the intermediate nozzle to be vertically movable. A compression coil spring for biasing the suction port member downward is interposed between the suction port member and the guide nozzle. A stopper for regulating the upper end boundary of the intermediate nozzle is located above the collar of the intermediate nozzle and supported on the frame side to be vertically movable.

In this arrangement, the suction port members and the intermediate nozzles can be lightly moved without any distortion caused by the tensile forces of the tension coil springs and the suction air force, which act in the axial direction of the intermediate nozzles. When the suction port members are moved upward together with a paper sheet being chucked thereon, the stoppers are moved upward while regulating the upward movements of the suction port members, and the suction port members and the intermediate nozzles can smoothly follow the stoppers and be moved upward without any distortion. Therefore, a paper feed error can be prevented to decrease the waste paper. Good follow-up performance can be obtained in a high-speed operation to achieve high-speed feeding. Furthermore, the durability of the components are improved by eliminating the distortion of the suction port members or the like.

Even in the high-speed operation, the suction port members which are quickly moved upward together with the paper sheet being chucked thereon temporarily stop when the suction port members abut against the stoppers. Hence, the suction port members are moved by a smaller ascending amount than that of continuous ascending without any stop. The operation lag between the left and right suction port members can be avoided to improve the feeding function. When the suction port members abut against the stoppers, an impact is generated to reliably separate the chucked paper sheet from the second paper sheet, thereby obtaining a more improved feeding function.

What is claimed is:

1. A paper feed suction apparatus comprising:

a cylindrical guide nozzle supported on a frame side and having an inner hole connected to an air source;

a cylindrical intermediate nozzle with a collar, fitted on an outer circumferential surface of said guide nozzle to be vertically movable;

a tension coil spring, having an upper end portion fixed on said guide nozzle side and a lower end portion fixed on said intermediate nozzle side, for biasing said intermediate nozzle upward;

a bottomed-cylindrical suction port member fitted on an outer circumferential surface of said intermediate nozzle to be vertically movable and having a suction hole in a lower end face thereof;

a compression coil spring, interposed between said suction port member and said guide nozzle, for biasing said suction port member downward; and a stopper, supported on said frame side to be vertically movable and located above said collar of said intermediate nozzle, for regulating an upper end limit of said intermediate nozzle.

* * * * *